US006056570A

United States Patent [19]

Maejima

[11] Patent Number: 6,056,570

[45] Date of Patent: May 2, 2000

[54] LOW COUPLING FORCE CONNECTOR

[75] Inventor: Toshiro Maejima, Shizuoka, Japan

[73] Assignee: Yazaki Corporation, Tokyo, Japan

[21] Appl. No.: 09/276,526

[22] Filed: Mar. 25, 1999

Related U.S. Application Data

[62] Division of application No. 08/760,163, Dec. 3, 1996.

[30] Foreign Application Priority Data

Dec. 4, 1995 [JP] Japan ..... 7-315246

[51] Int. Cl.[7] ..... H01R 13/62

[52] U.S. Cl. ..... 439/259; 439/310

[58] Field of Search ..... 439/259–262, 439/310, 362

[56] References Cited

U.S. PATENT DOCUMENTS

| | | | |
|---|---|---|---|
| 4,586,771 | 5/1986 | Kraemer et al. | 439/310 |
| 5,061,197 | 10/1991 | Kuzuno et al. | 439/262 |
| 5,110,301 | 5/1992 | Inoue et al. | 439/310 |
| 5,419,711 | 5/1995 | Noro et al. | 439/259 |

FOREIGN PATENT DOCUMENTS

| | | |
|---|---|---|
| 26 40 580 B2 | 7/1978 | Germany . |
| 27 07 122 C2 | 4/1982 | Germany . |
| 5-90843 | 12/1993 | Japan . |

*Primary Examiner*—Hien Vu

*Attorney, Agent, or Firm*—Finnegan, Henderson, Farabow, Garrett & Dunner, L.L.P.

[57] ABSTRACT

A terminal-operating plate is movably mounted on an upper wall of a connector housing. The upper wall has guide slits formed therein which communicate to respective terminal-accommodating chambers where terminal lugs each with a wire are accommodated. The terminal-operating plate has terminal drive arms projecting therefrom which engage with the terminal lugs in the terminal-accommodating chambers. The connector housing is coupled to a mating connector housing, with terminal lugs positioned in the terminal-accommodating chambers, followed by moving the terminal-operating plate in the fitting direction of the connectors to bring the terminal lugs into contact with terminal lugs in a mating connector housing. A pair of connector housings are securely and easily fitted to each other with a low coupling force. The construction is suited for a multi-polar connector.

8 Claims, 11 Drawing Sheets

LOW COUPLING FORCE CONNECTOR

This is a division of application Ser. No. 08/760,163, filed Dec. 3, 1996., all of which are incorporated herein by reference.

BACKGROUND OF THE INVENTION

1. Field of the Invention

This invention relates to a low coupling force connector whose pair of connector housings are fitted to each other with a reduced force.

2. Description of the Related Art

A typical drawback of a multipolar connector with a large number of terminals contained therein is that its connector housings are difficult to fit, thereby requiring a large coupling force.

To facilitate the coupling of connectors, a lever-type connector k as shown in FIG. 16 is disclosed in Japanese Utility Model Application Laid-Open Specification No. 5-90843, which enables the connector housings even of a multipolar connector to be easily fitted with a relatively small force by means of a lever.

The lever-type connector k comprises a pair of connector housings a and b, and a lever c rotatably provided on one of the connector housings a. The lever c, after guide pins e of the connector housing b are inserted into its guide recesses d, is rotated to fit the connector housings a and b to each other.

Such a lever-type connector, however, has a drawback that, with a housing employed which is increased in length for containing an increased number of terminals, the housing possibly yields during the fitting thereby wrapping at a central portion thereof or slanting relative to the mating housing. This wrapping or slanting makes it impossible to complete the fitting and requiring troublesome work for its correction.

Another possible slider-type connector K', as shown in FIG. 17, utilizes a cam. The connector K' comprises a housing h and a slider g movably mounted on the housing. In this connector, by moving the slider g in a direction perpendicular to the fitting direction of the housing h, guide pins k of the housing h in cam grooves j provided in the slider j are moved in the fitting direction, thereby causing of the housing h with its mating housing.

Another drawback of connector k' is that it requires a space for the moving operation of the slider g, which space becomes larger with an increase in size of the housing h, and thus is limited in its applications.

The lever-type and slider-type connectors as mentioned above is that their lever and slider are apt to get out of place and require troublesome work to get them back in place.

SUMMARY OF THE INVENTION

This invention has been accomplished to overcome the above drawbacks and an object of this invention is to provide a reliable low coupling force connector whose connector housings are securely and easily fitted to each other with a reduced force, and which is suited as a multipolar connector.

In order to attain the object, according to an aspect of this invention, there is provided a low coupling force connector which comprises: a pair of connector housings fittable to each other; a terminal-operating plate mounted on an outer wall of one of the connector housings, movable in a fitting direction of the connector housings, the one connector housing having a plurality of terminal-accommodating chambers formed therein; guide slits provided in the outer wall of the one connector housing, the guide slits each communicating to a respective one of the terminal-accommodating chambers; and a plurality of terminal drive arms extending from the terminal-operating plate through respective ones of the guide slits into the terminal-accommodating chambers, wherein the connector housings are fitted to each other, with wire-attached terminal lugs held in preliminarily-looked position and each engaged with a respective one of the terminal drive arms, followed by moving the terminal-operating plate in the fitting direction of the connector housings to bring the terminal lugs into fitting with mating terminals in the other connector housing.

Advantageously, a plurality of terminal-operating plates are independently movable mounted on the one connector housing.

Preferably, the terminal drive arms of the terminal-operating plate each has a drive recess, and the terminal lugs each has a corresponding driven projection engageable in the drive recess.

Preferably, the low coupling force connector further comprises locking means for holding the terminal-operating plate in preliminarily- and fully-locked positions on the one connector housing.

Preferably, the locking means comprises a guide frame provided on the one connector housing, the guide frame having a locking projection, and a preliminarily- and a fully-locking hole provided on the terminal-operating plate, engageable with the locking projection.

According to another aspect of this invention, there is provided a low coupling force connector which comprises: a pair of connector housings fittable to each other; a terminal-operating plate with a cam groove formed thereon, the cam groove including an inclined portion; and an operating plate passage provided in one of the connector housings, the one connector housing having a plurality of terminal-accommodating chambers formed therein, the operating plate passage being formed by cutting off a partion of walls of the terminal-accommodating chambers, wherein the connector housings are fitted to each other, with wire-attached terminal lugs, each having a driven projection engageable in the cam groove, held in preliminarily-locked position, followed by inserting the terminal-operating plate into the operating plate passage to bring the terminal lugs along the cam groove towards the other connector housing and into fitting with mating terminals in the other connector housing.

Preferably, the one connector housing has on an outer wall thereof support arms and a locking means, and the terminal-operating plate has rotary recesses on opposite surfaces at one end thereof and guide grooves longitudinally extending from the rotary recesses towards the other end of the terminal-operating plate, the support arms having respective support projections opposed to each other and fitted in the rotary recesses so that when the connector housings are not in use, the terminal-operating plate is held in place along the outer wall of the one connector housing by means of the locking means, and when the connector housings are fitted, the terminal-operating plate is rotated about the support projections and inserted into the operating plate passage.

In the above connectors according to this invention, since the mutual fitting of connector housings and the mutual fitting of terminals contained in the connector housings are separately done, the fitting force required is broken up, making it possible to effect the coupling with a low coupling force as compared with the case where both connector housings and terminals are fitted at one time.

Especially where a plurality of terminal-operating plates are employed which are separately moved, the fitting of all the terminals can be effected with a lower coupling force.

The above and other objects, features a nd advantages of this invention will become apparent from the following description and the appended claims, taken in conjunction with the accompanying drawings in which like parts or elements are denoted by like reference characters.

DESCRIPTION OF THE PREFERRED EMBODIMENTS

Embodiments of this invention will now be described with reference to the attached drawings.

Figure 1:
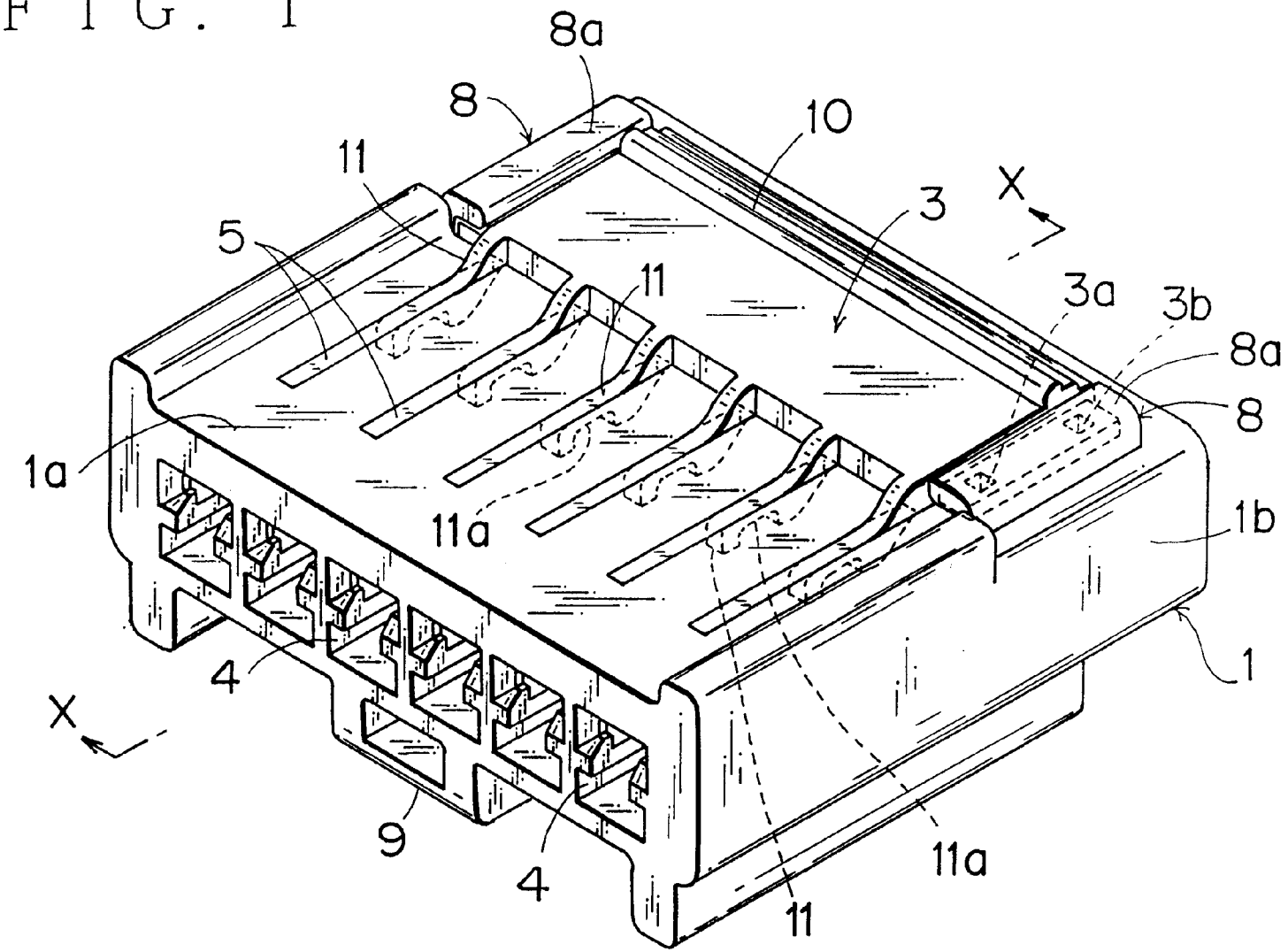
FIG. 1 is a perspective view of one of the connector housings of a low coupling force connector according to one embodiment of this invention, shown with a terminal-operating plate.

FIG. 1 shows a connector housing 1 and a terminal-operating plate 3 mounted on the connector housing. The connector housing 1 is one of a pair of connector housings constituting a low coupling force connector according to one embodiment of this invention.

Figure 2:
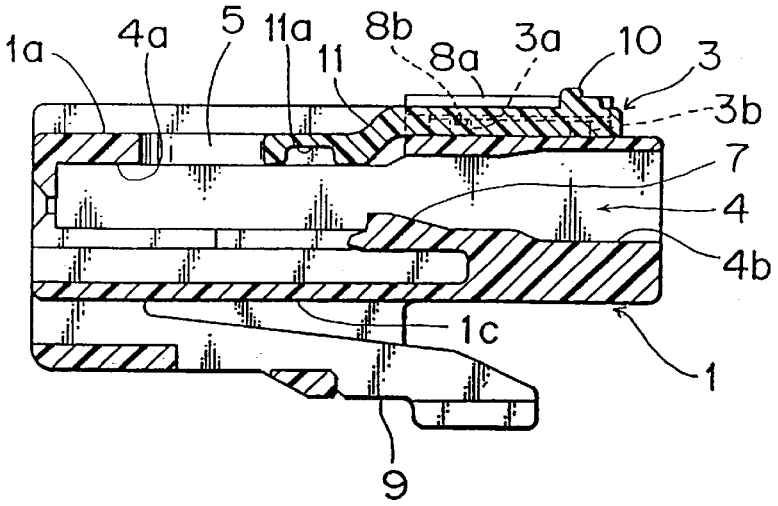
FIG. 2 is a sectional view taken along the line X—X of FIG. 1.
Figure 3:
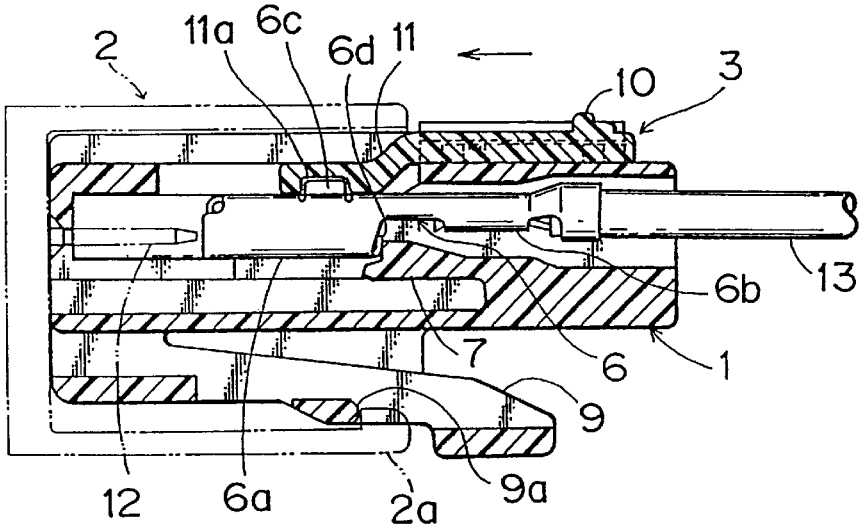
FIG. 3 is a sectional view showing the state where a terminal lug inserted into a terminal-accommodating chamber of the connector housing of FIG. 1 is held in a preliminarily-locked position.

The connector housing 1 has a plurality of terminal-accommodating chambers 4 formed in a row therein, and a corresponding number of guide slits 5 formed in its upper wall 1*a*, which communicate to the respective terminal-accommodating chambers 4 as shown in FIG. 2. As best seen in FIG. 3, a resilient locking piece 7 is provided on a bottom wall 4*b* of each terminal-accommodating chamber 4 for holding a terminal lug 6 in place.

Guide frames 8, 8 of L-shaped cross section are provided on opposite lateral walls 1*b*, 1*b* of the connector housing 1 near their rear ends, and a locking arm 9 is provided on its bottom wall 1*c* for locking the connector housing 1 to the other connector housing 2 (see FIG. 3).

The terminal-operating plate 3 has a flat shape, and is movably mounted between the guide frames 8 of the connector housing 1. Also, the plate 3 has a ridge-like operating bulge 10 at the rear end, and has, at the front end, spaced terminal drive arms 11 corresponding to each of the terminal-accommodating chambers 4 of the connector housing 1. Free ends of the plate extend in the fitting direction of the connector housings 1 and 2. Each terminal drive arm 11 has a drive recess 11*a* formed at its free end.

The terminal-operating plate 3 has preliminarily locking holes 3*a* and fully locking holes 3*b*at opposite lateral ends, and the guide frames 8 has locking projections 8*b* on the under side of upper walls 8*a*, which engage in the locking holes 3*a* or 3*b* to respectively lock the terminal-operating plate 3 in preliminarily locked position or fully locked position.

A terminal lug 6 has a female electric contact portion 6*a* which a male terminal 12 of the other connector housing 2 is fitted into to make electric connection. A wire 13 is attached at a wire attach portion 6*b* located at a rear portion of the terminal lug 6. On top of the electric contact portion 6*a* of the terminal lug 6, a driven projection 6*c* is provided. The driven projection 6*c* engages with which the drive recess 11*a* of the terminal drive arm 11 of the terminal-operating plate 3.

The coupling operation for the low coupling force connector as mentioned above will now be described.

The terminal-operating plate 3 is first inserted between the guide frames 8, 8 of the one connector housing 1, and the locking projections 8*b* of the guide frames 8 are engaged in the preliminarily locking holes 3*a* of the terminal-operating plate 3 to hold the latter in preliminarily locked position. Terminal lugs 6 are then inserted into the terminal-accommodating chambers 4 of the connector housing 1.

The terminal lug 5 inserted into a terminal-accommodating chamber 4 is locked in preliminarily locked position therein by the engagement of its locking portion 6*d* with the resilient locking piece 7 and the engagement of its driven projection 6*c* in the drive recess 11*a* of the terminal drive arm 11 of the terminal-operating plate 3, as shown in FIG. 3.

The connector housings 1 and 2, are fitted to each other, with the terminal lugs 6 held in preliminarily locked position, and a lock claw 2*a* of the connector housing 2 engages in a lock hole 9*a* provided in the locking arm 9 of the connector housing 1 to lock the connector housings 1 and 2 together. FIG. 3 shows the connector housings 1 and 2 locked together, at which the terminal lug 6 is still not in contact with the male terminal 1 of the connector housing 2.

Figure 4:
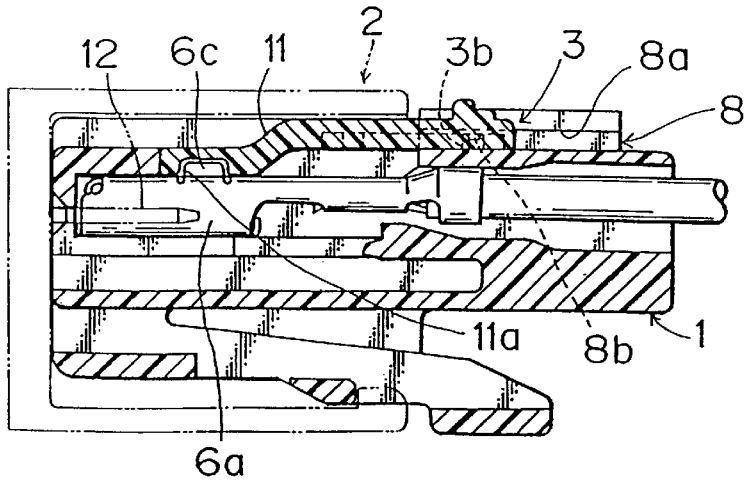
FIG. 4 is a sectional view showing terminal lugs fitted to each other by moving the terminal-operating plate of FIG. 3.

After completion of the fitting of the connector housings 1 and 2, the terminal-operating plate 3 is moved in the direction of an arrow in FIG. 3, so that the terminal drive arm 11 of the terminal-operating plate 3 brings the terminal lug 6 forwardly and its electric contact portion 6*a* fits with the male terminal 12 as shown in FIG. 4. On the other hand, the locking projections 8*b* of the guide frames 8 engage in the fully locking holes 3*b* of the terminal-operating plate 3 to lock the plate 3 to the connector housing 1.

To disengage the terminal lug 6 from the male terminal 12, the terminal-operating plate 3 is moved in the direction opposite to that of the arrow in FIG. 3, so that the terminal drive arm 11 of the terminal-operating plate 3 brings the terminal lug 6 apart from the male terminal 12. After the terminal lug 6 is separated from the male terminal 12, the connector housings 1 and 2 are disengaged from each other. In this way, the force required for uncoupling the connector housings is broken up into two, one for the disengagement of the terminals from each other and the other for the disengagement of the connector housings, making it possible to uncouple with a smaller force than that required for disengaging both at one time.

While in the above example, a single terminal-operating plate 3 is employed for moving all the terminal lugs 6 in the row of terminal-accommodating chambers in the connector housing 1, it is also possible to employ a plurality of terminal-operating plates corresponding to divisions of the plate 3, each individually movably mounted on the connector housing, so that the terminal lugs are successively brought in groups into fitting with mating male terminals.

In this case, the force required for moving the terminal lugs is broken up into forces each required for moving one group of terminal lugs. Thus, even with a connector housing with a large number of terminal-accommodating chambers, all the terminal lugs can be brought into fitting with mating terminals with a low operating force. Such a structure is advantageously used for multipolar connectors.

Further, it is also possible to provide the one connector housing with two tiers of terminal-accommodating chambers and with two terminal-operating plates on the top and bottom surfaces of the one connector housing for moving the terminal lugs.

Figure 5:
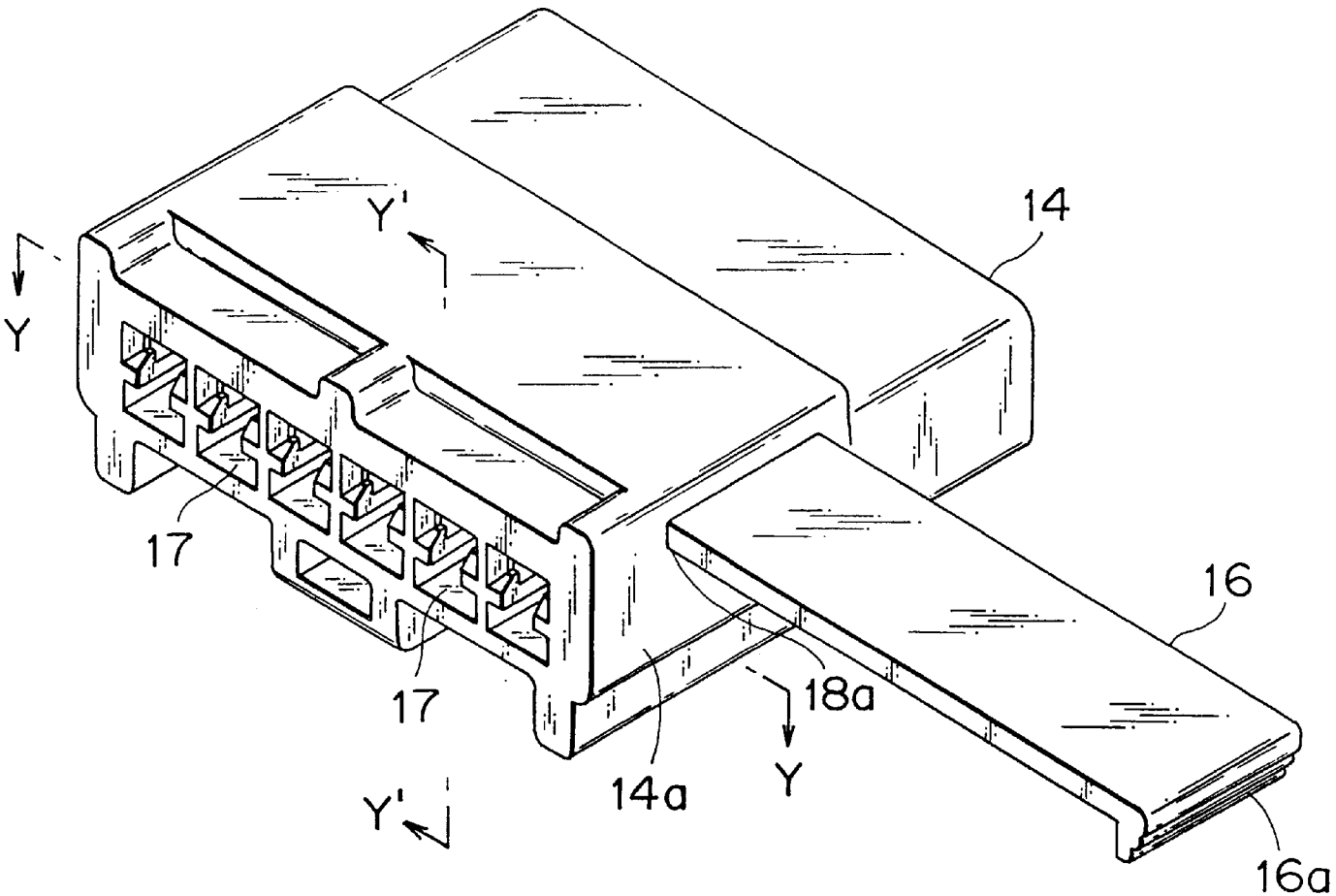
FIG. 5 is a perspective view of one of the connector housings of a low coupling force connector according to another embodiment of this invention, shown with a terminal-operating plate.

FIG. 5 shows a connector housing 14 and a terminal-operating plate 16 with an end thereof inserted into the connector housing. The connector housing 14 and a mating connector housing 15 constitute a low coupling force connector according to another embodiment of this invention.

Figure 6:
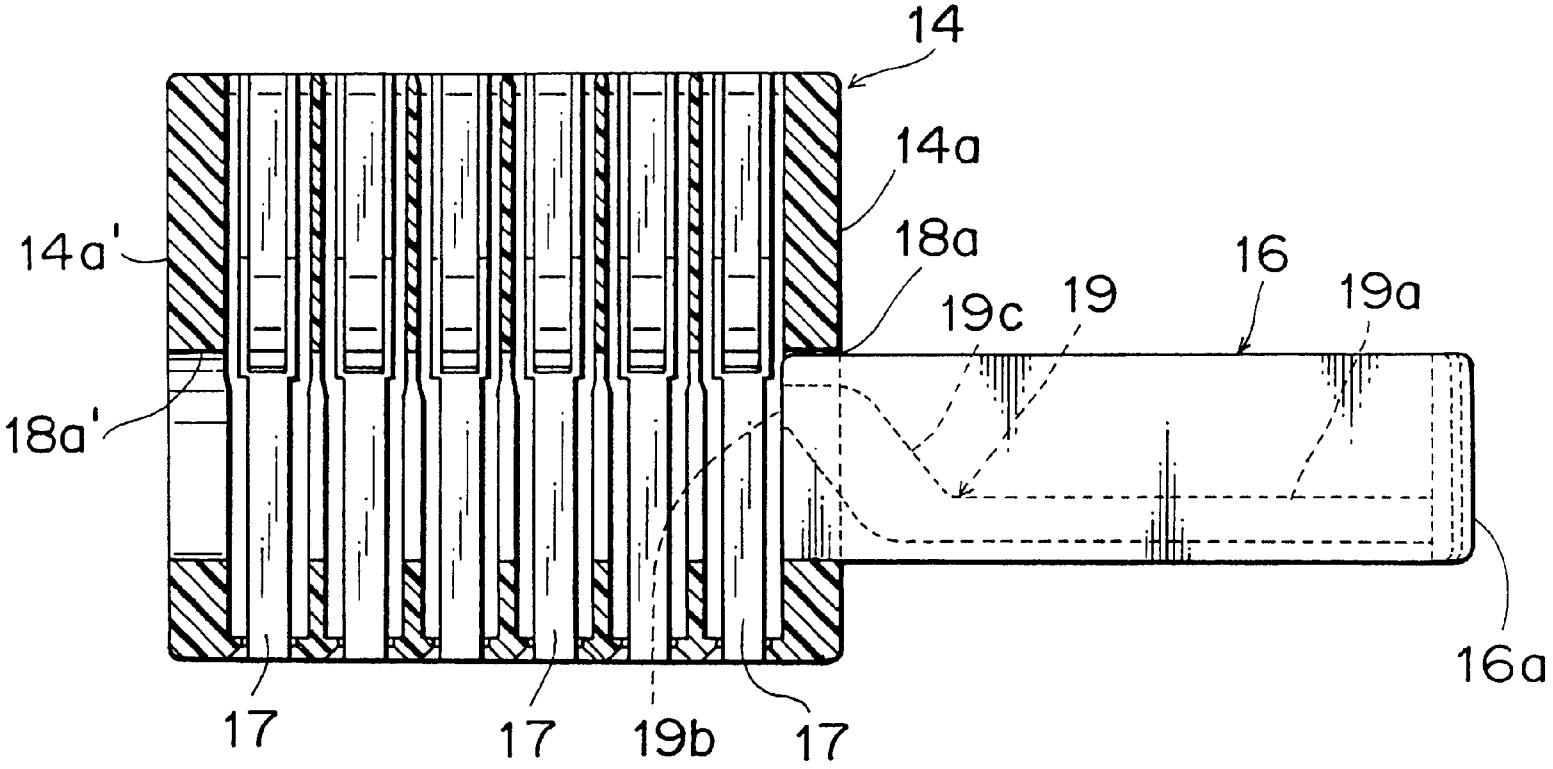
FIG. 6 is a sectional view taken along the line Y—Y of FIG. 5.
Figure 7:
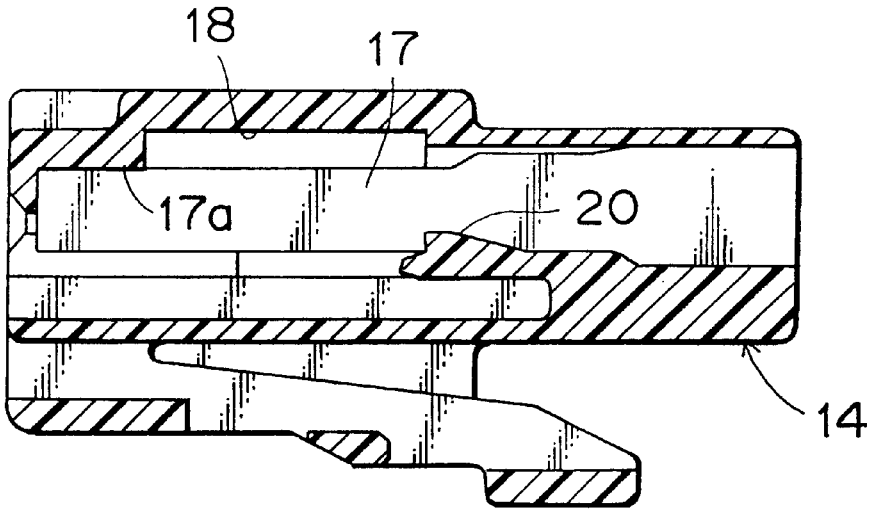
FIG. 7 is a sectional view taken along the line Y'—Y' of FIG. 5.

The connector housing 14 has a plurality of terminal-accommodating chambers 17 formed in a row therein, which have their upper walls 17*a* partially cut off to form an operating plate passage 18, as shown in FIGS. 6 and 7. The connector housing 14 is on opposite lateral walls 14*a*, 14*a*' provided with openings 18*a*, 18*a*' leading to the operating plate passage 18.

A terminal-operating plate 16 has an elongated shape as shown in FIG. 6 and has an operating portion 16*a* at one end thereof and a cam groove 19 on the side of the terminal-operating plate 16 that is adjacent the terminal-accommodating chambers 17 when the terminal-operating plate 16 is inserted into operating plate passage 18. The cam groove 19 consists of a parallel portion 19*a* extending from the side of the operating portion 16*a* over all the terminal-accommodating chambers 17, an inlet portion 19*b* at the end remote from the operating portion 16*a*, and an inclined portion 19*c* extending from the parallel portion 19*a* to the inlet portion 19*b*. The width of the parallel portion 19*a* of the cam groove 19 is set in accordance with the size of the driven projections formed on the terminal lugs to be introduced, and in the present example adapted for the same driven projections 6*c* of the terminal lugs 6 as in the preceding example.

The fitting operation with the terminal-operating plate 16 will now be described.

Figure 8:
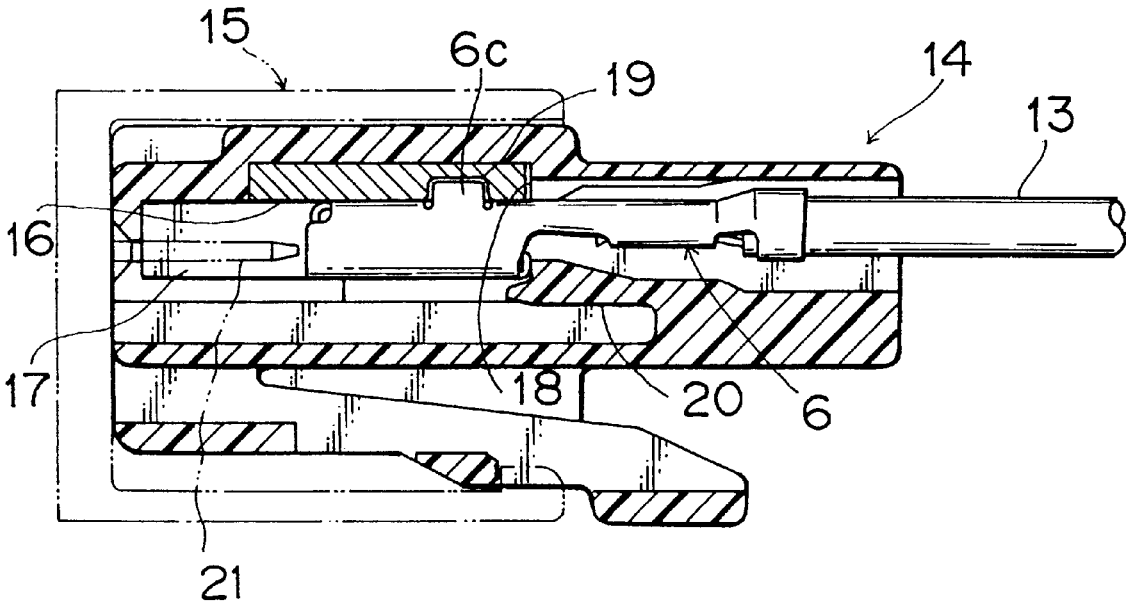
FIG. 8 is an explanatory view showing the process of a terminal lug being moved after the connector housing of FIG. 5 and a mating connector housing are fitted.

As shown in FIG. 8, terminal lugs 6, each having a wire 13, are first inserted into the terminal-accommodating chambers 17 of the one connector housing 14 and locked in place by means of the related resilient locking pieces 20. The one connector housing 14 is then fitted with the other connector housing 15. The terminal-operating plate 16 is then inserted through the opening 18*a* provided in the lateral wall 14*a* of the one connector housing 14 into the operating plate passage 18. In this instance, the driven projections 6*c* of terminal lugs 6 are positioned in alignment with the inlet 19*b* of the cam groove 19.

Figure 9:
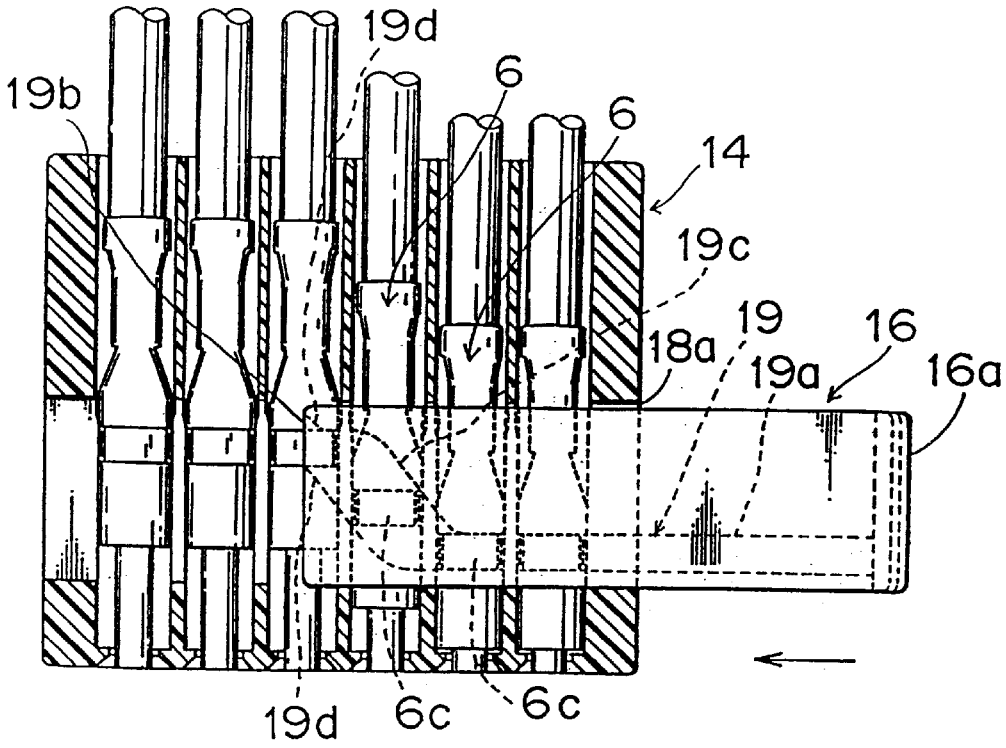
FIG. 9 is an explanatory view showing the process of terminal lugs being moved along a cam groove on the terminal-operating plate of FIG. 8.
Figure 10:
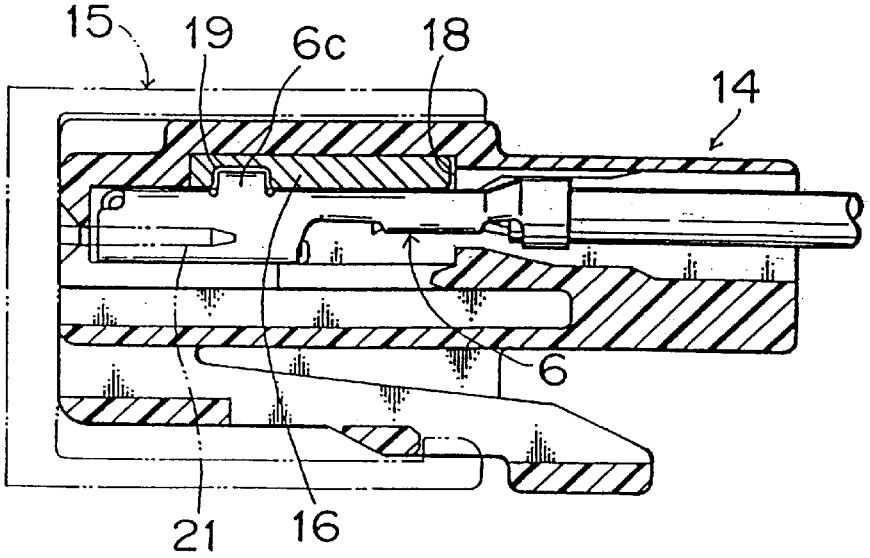
FIG. 10 is a sectional view showing the state where the terminal lug of FIG. 8 is fitted with a mating male terminal.

If the terminal-operating plate 16 is pushed in the direction of an arrow in FIG. 9, as the plate 16 advances, the driven projections 6*c* of the terminal lugs 6 are successively moved into the inlet portion 19*b* and along the inclined portion 19*c* of the cam groove 19 towards the male terminals 21 in the other connector housing 15 until fitted and electrically connected therewith as shown in FIG. 10.

The inlet portion 19*b* of the cam groove 19 can be at opposite sides provided with tapers 19*d*, 19*d* to facilitate and ensure the introduction of the driven projections 6*c* of terminal lugs 6 into the cam groove 19.

When the terminal-operating plate 16 is fully inserted, the driven projections 6*c* of all terminal lugs 6 are positioned in line in the parallel portion 19*a* of the cam groove 19, and the fitting of all the terminal lugs 6 with their mating male terminals 21 is completed.

Since terminal lugs 6 and male terminals 21 are fitted to each other in order along the inclined portion 19*c* of the cam groove 19, the total force required for fitting all the male and female terminals to each other is broken up into the individual required for fitting each individual terminal lug 6, which is located in the inclined portion 19*c* of the cam groove 19, to its corresponding individual mating terminal 21. This results in all the terminal lugs 6 being sequentially fitted with the male terminals generally with a low force irrespective of the number of terminals to be fitted.

To disengage the terminal lugs 6 from the male terminals 21, the terminal-operating plate 16 is pulled out of the operating plate passage 18, at which the driven projections 6*c* of the terminal lugs 6 are successively driven back along the inclined portion 19*c* of the cam groove 19 and separated from their mating terminals with a small operating force as when they are fitted.

Figure 11:
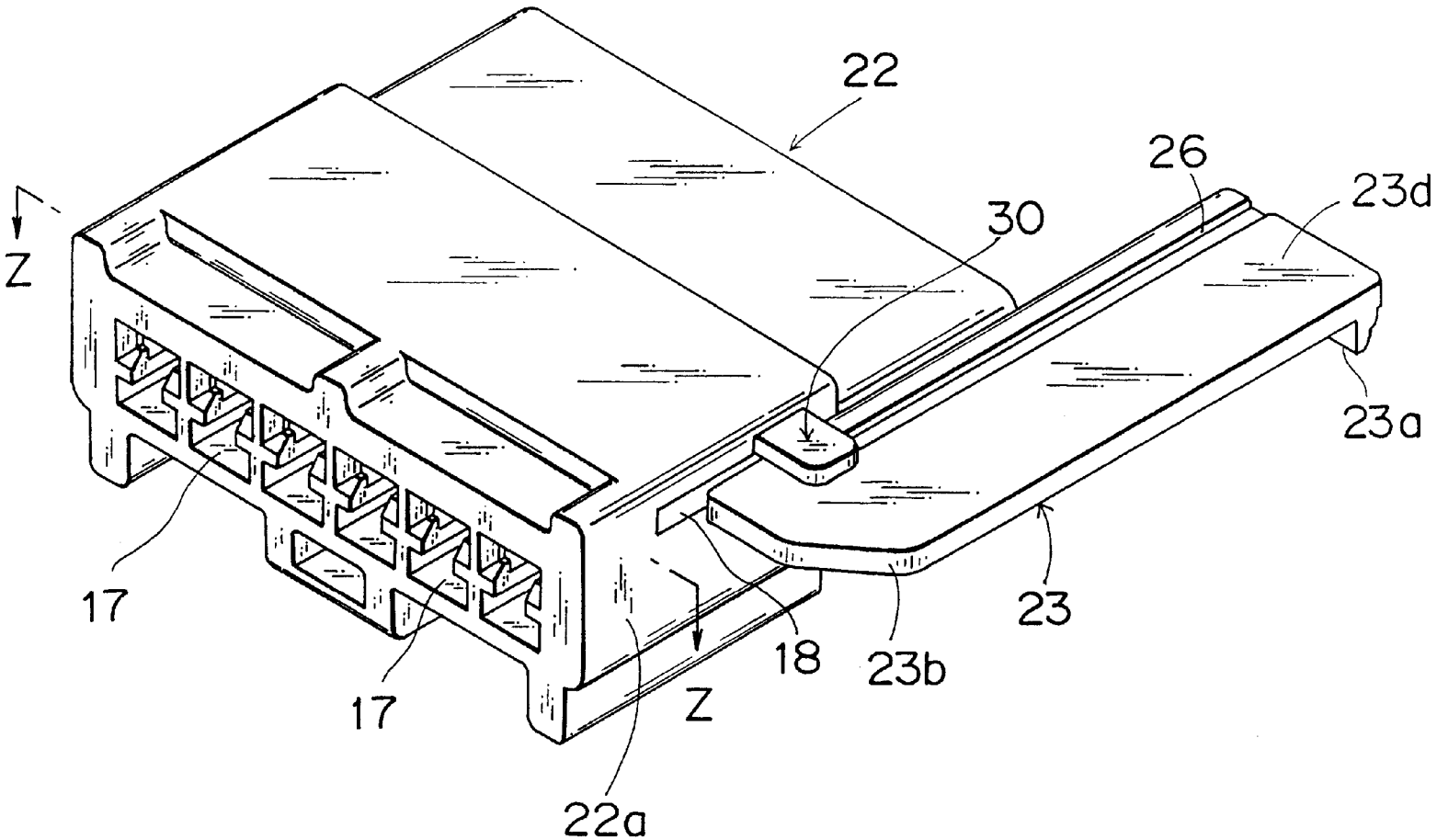
FIG. 11 is a perspective view of one of the connector housings of a low coupling force connector according to another embodiment of this invention.
Figure 12:
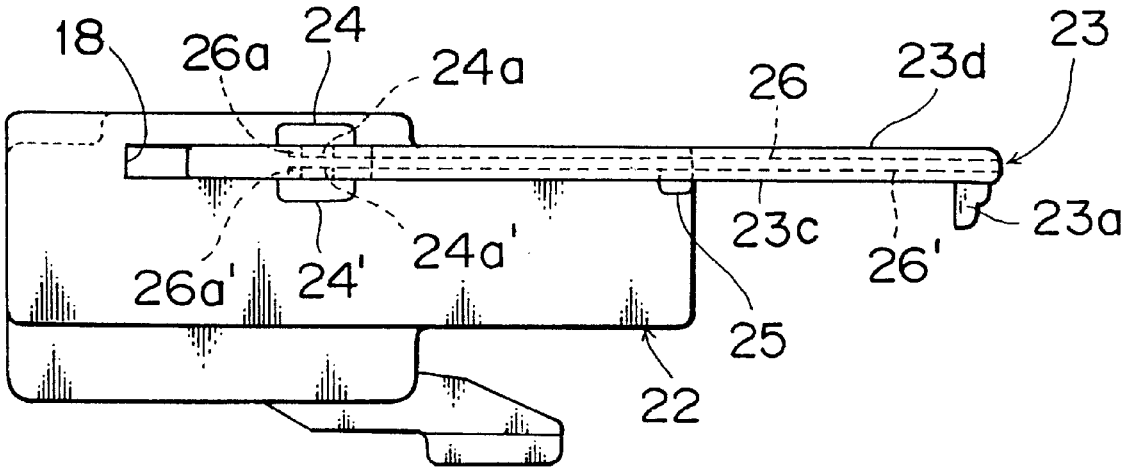
FIG. 12 is a side view of the connector housing of FIG. 11.

FIGS. 11 and 12 show a connector housing 22 which is one of a pair of connector housings constituting a low coupling force connector according to a further embodiment of this invention. The other connector housing is identical to the connector housing 15 as in the preceding example, and its description will be omitted.

The one connector housing 22 is on a lateral wall 22*a* thereof provided with a support 24 for rotatably supporting a terminal-operating plate 23 and with a locking projection 25 for locking the operating plate 23 lengthwise along the lateral wall 22*a* when the connector housing 22 is not in use.

When the connector housings are fitted, the terminal-operating plate 23 is rotated and inserted into the connector housing 22 to operate the terminal lugs therein.

The connector housing 22 has the same structure as the connector housing 14 in the preceding example except for the support 30 and the locking projection 25 on its lateral wall 22*a*, and has the same terminal-accommodating chambers 17 and operating plate passage 18 as in the preceding connector housing 14. Therefore, its description will be omitted.

Figure 13:
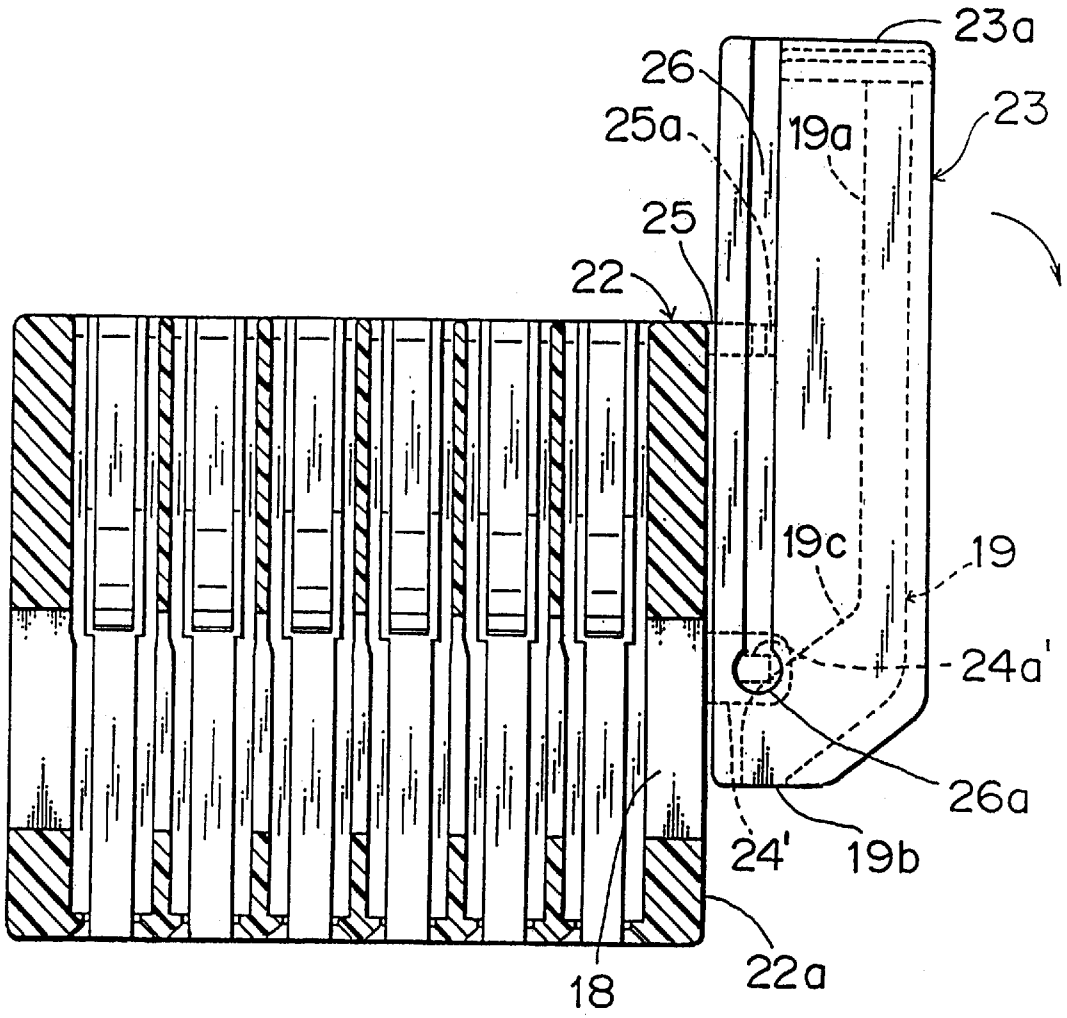
FIG. 13 is a sectional view taken along the line Z—Z of FIG. 11.

The terminal-operating plate 23 has an operating portion 23*a* at one end and has one corner cut off at the other end to form an introduction end 23*b*. As shown in FIG. 13, on the underside 23*c* of the terminal-operating plate 23, a cam groove 19 is formed in the same manner as the terminal-operating plate 16 in the preceding example, which consists of a parallel portion 19*a*, an inlet portion 19*b* and an inclined portion 19*c*.

The terminal-operating plate 23 is, on its top and bottom surfaces 23*d*, 23*c* at the lateral side remote from the parallel portion 19*a* of the cam groove 19, provided with guide grooves 26, 26' which extend parallel in a longitudinal direction of the terminal-operating plate 23 with an equal spacing from the lateral end of the plate 23. The guide grooves 26, 26' extend at one end to the operating portion 23*a* and at the other end have circular rotary recesses 26*a*, 26*a*' of the same diameter on opposite sides of the operating plate 23. The rotary recesses 26*a*, 26*a*' are of such diameter as to allow support projections 24*a*, 24*a*' of the later-described support arms 24, 24' to fit therein and the operating plate 23 to rotate around the support projections 24*a*, 24*a*'.

The support arms 24, 24' constituting the support 30 have respective support projections 24*a*, 24*a*' which are opposed to each other. Each support projection 24*a*, 24*a*' is a horizontally elongate body of such a shape as is formed by cutting off diametrically opposite sides of a columnar body to leave a central portion thereof, which columnar body has a diameter fittable into the rotary recess 26*a*, 26*a*' of the guide groove 26, 26'. The support projection (elongate body) 24*a*, 24*a*' has a width fittable in to the guide groove 26, 26' of the terminal-operating plate 23 when t he plate 23 is aligned with and insert ed into the operating plate passage 18.

The support projections 24*a*, 24*a*' are fitted in the respective rotary recesses 26*a*, 26*a*' of the terminal-operating plate 23 and rotatably support the operating plate 23.

The locking projection 25 has at the free end a locking claw 25*a* which is engageable in the guide groove 26' on the underside 23*c* of the terminal-operating plate 23 to lock the operating plate to the lateral wall 22*a* of the connector housing 22 when the connector housings are not coupled.

Figure 14:
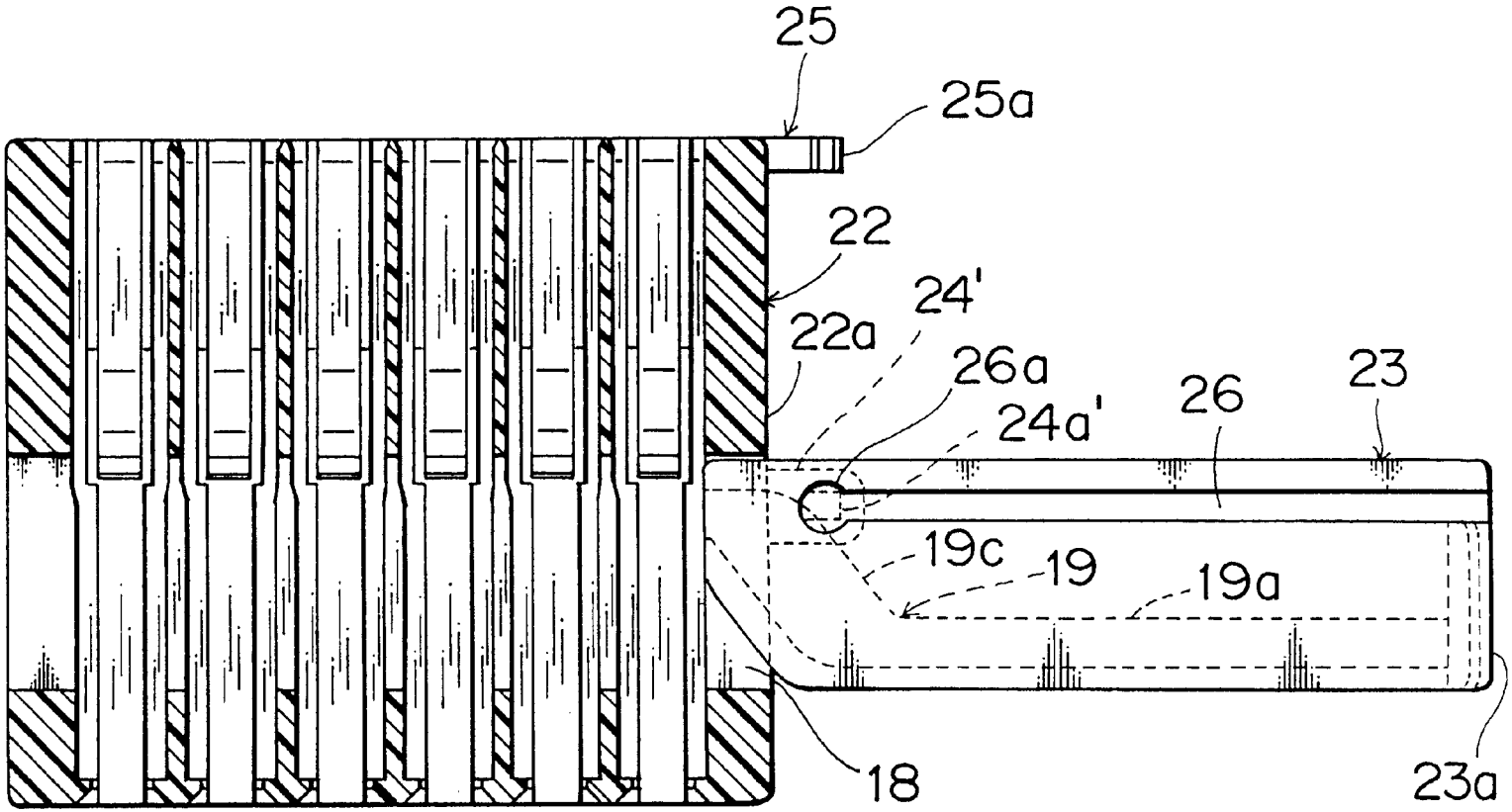
FIG. 14 is an explanatory view showing the state where the terminal-operating plate of FIG. 13 is rotated.

To insert the terminal-operating plate 23 into the operating plate passage 18 of the connector housing 22, the plate 23 is rotated in the direction of an arrow in FIG. 13 to assume the insertion position as shown in FIG. 14, where the longitudinal direction of the support projections 24*a*, 24*a*' align with the direction of the guide grooves 26, 26' to enable the support projections 24*a*, 24*a*' to advance into the respective guide grooves 26, 26'.

Figure 15:
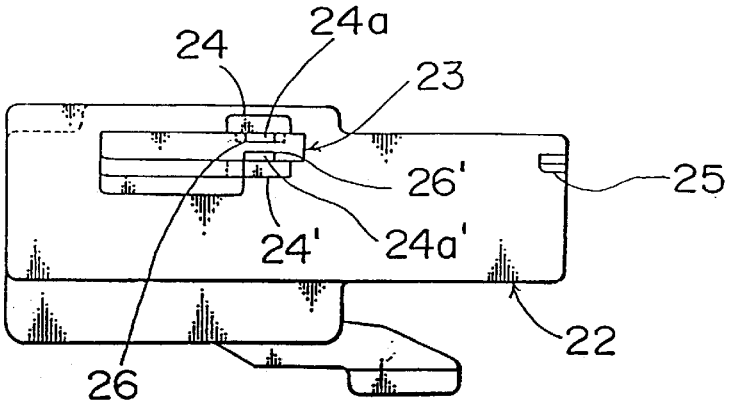
FIG. 15 is a side view showing the state where the terminal-operating plate is inserted into the connector housing of FIG. 11.
Figure 16:
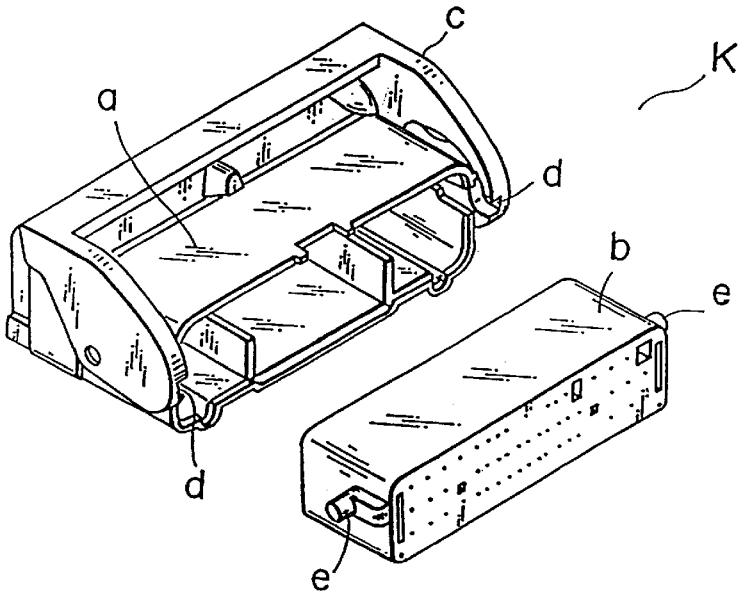
FIG. 16 PRIOR ART
FIG. 16 is a perspective view of a conventional lever-type connector.
Figure 17:
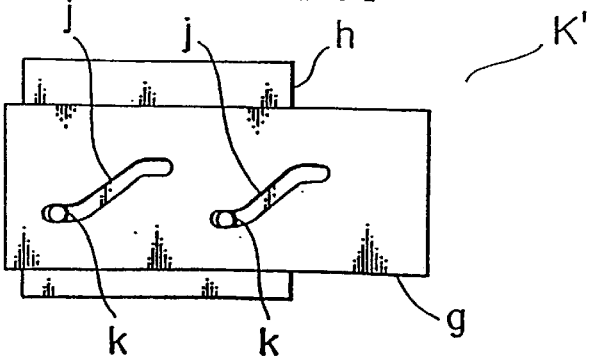
FIG. 17 PRIOR ART
FIG. 17 is an explanatory view of a conventional slider-type connector.

If pushed at the operating portion 23*a* in this state, the terminal-operating plate 23 is inserted into the operating plate passage 18 as shown in FIG. 15, with the support projections 24*a*, 24*a*' sliding inside the guide grooves 26, 26'.

The movement of terminal lugs caused by the insertion of the terminal-operating plate 23 into the operating-plate passage 18 is the same as that described in the preceding example in connection with the terminal-operating plate 16 inserted into the connector housing 14, and its description will be omitted.

Since the terminal-operating plate 23 is always mounted at the lateral wall 22*a* of the connector housing 22, it becomes unnecessary to provide or arrange for separate terminal-operating plates when connector housings are coupled. Further, it becomes unnecessary to do the positioning operation of the terminal-operating plate 23 for its insertion into the operating plate passage 18, resulting in the insertion operation facilitated and an improved operability.

Having now fully described the invention, it will be apparent to one of ordinary skill in the art that many changes and modifications can be made thereto without departing from the spirit and scope of the invention as set forth herein.

What is claimed is:

1. A low coupling force electrical connector assembly comprising:

a pair of connector housings configured to fit to each other in a fitting direction;

a terminal-operating plate with a cam groove formed thereon, said cam groove including an inclined portion;

an operating plate passage provided in one of said connector housings, said one of said connector housings having a plurality of terminal-accommodating chambers formed therein, said terminal-accommodating chambers oriented in the fitting direction, and said operating plate passage being contiguous to said chambers and oriented in a direction substantially perpendicular to the fitting direction;

a plurality of terminal lugs positioned within said terminal-accommodating chambers, each terminal lug having a driven projection engageable in said cam groove; and said terminal-operating plate being insertable into said operating plate passage in said substantially perpendicular direction to slide said terminal lugs along said cam groove in the fitting direction towards the other of said connector housings, thereby mating said terminal lugs with mating terminals positioned within said other of said connector housings.

2. A low coupling force electrical connector assembly according to claim 1, wherein said one of said connector housings has support arms on a lateral wall thereof, and said terminal-operating plate has rotary recesses on opposite surfaces at one end thereof and guide grooves longitudinally extending from said rotary recesses towards the other end of said terminal-operating plate, said support arms having support projections opposed to each other and fitted in said rotary recesses so that when said connector housings are not fitted to each other, said terminal-operating plate is positioned along said lateral wall of said one of said connector housings, and when said connector housings are fitted to each other, said terminal-operating plate is rotated about said support projections and inserted into said operating plate passage.

3. The low coupling force electrical connector assembly of claim 2, wherein said one of said connector housings has locking means on a lateral wall thereof, and when said connector housings are not fitted to each other, said terminal-operating plate is retained along said lateral wall of said one of said connector housings by said locking means.

4. A low coupling force electrical connector assembly comprising:

first and second connector housings configured to fit to each other in a fitting direction;

said first connector housing having a plurality of parallel walls and chambers formed between said walls, said chambers configured to accommodate wire terminals, each wire terminal oriented in the fitting direction and having a driven projection;

said second connector housing configured to accommodate a plurality of mating terminals for mating with the wire terminals;

an operating plate passage provided in said first connector housing, said operating plate passage being contiguous to said chambers and oriented in a direction substantially perpendicular to the fitting direction;

a terminal-operating plate having a cam groove; and said terminal-operating plate being insertable into said operating plate passage in said substantially perpendicular direction whereby said cam groove engages the driven projections of the wire terminals thereby sliding the wire terminals in the fitting direction along said cam groove towards said second connector housing to mate with the mating terminals of said second connector housing.

5. The low coupling force electrical connector assembly of claim 4, wherein the terminal-operating plate is rotatably and slidably coupled to the first connector housing.

6. The low coupling force electrical connector assembly of claim 5, wherein the terminal-operating plate is rotatable from a first, insertable position to a second, stowed position.

7. The low coupling force electrical connector assembly of claim 6, wherein the first connector housing has a locking projection for retaining the terminal-operating plate in the second, stowed position.

8. The low coupling force electrical connector assembly of claim 4, wherein the cam groove of the terminal-operating plate includes an inclined portion.

* * * * *